US009861128B2

(12) United States Patent
Liu

(10) Patent No.: US 9,861,128 B2
(45) Date of Patent: Jan. 9, 2018

(54) ELECTRONIC CIGARETTE

(71) Applicant: KIMREE HI-TECH INC., Tortola (VG)

(72) Inventor: Qiuming Liu, Shenzhen (CN)

(73) Assignee: HUIZHOU KIMREE TECHNOLOGY CO., LTD., SHENZHEN BRANCH, Shenzhen, Guangdong Province (CN)

( * ) Notice: Subject to any disclaimer, the term of this patent is extended or adjusted under 35 U.S.C. 154(b) by 634 days.

(21) Appl. No.: 14/372,744

(22) PCT Filed: Apr. 8, 2013

(86) PCT No.: PCT/CN2013/073873
§ 371 (c)(1),
(2) Date: Jul. 16, 2014

(87) PCT Pub. No.: WO2014/166043
PCT Pub. Date: Oct. 16, 2014

(65) Prior Publication Data

US 2015/0237915 A1 Aug. 27, 2015

(51) Int. Cl.
*A24F 47/00* (2006.01)
*A24D 3/04* (2006.01)

(52) U.S. Cl.
CPC ..... *A24F 47/008* (2013.01); *A24D 3/043* (2013.01)

(58) Field of Classification Search
CPC ..... A24F 47/008; A24D 3/043
See application file for complete search history.

(56) References Cited

U.S. PATENT DOCUMENTS 4,771,796 A 9/1988 Myer
2011/0303231 A1* 12/2011 Li ..... A24F 47/008 131/329
2011/0304282 A1* 12/2011 Li ..... A24F 47/008 315/362
2013/0340779 A1* 12/2013 Liu ..... A24F 47/008 131/329

FOREIGN PATENT DOCUMENTS

CN 201591125 U 9/2010
CN 201750712 U 2/2011

OTHER PUBLICATIONS

CN 201591125 (Machine Translation) [online], [retrieved on Nov. 7, 2016], retrieved from Espacenet (https://worldwide.espacenet.com/?locale=en_EP).*

* cited by examiner

*Primary Examiner* — Michael J Felton
*Assistant Examiner* — Yana B Krinker
(74) *Attorney, Agent, or Firm* — Cheng-Ju Chiang

(57) ABSTRACT

The present invention provides an electronic cigarette including a nozzle, a battery rod assembly and an atomizer assembly. The nozzle defines vent holes. The nozzle and the atomizer assembly are located at two ends of the battery rod assembly respectively, and the battery rod assembly defines a smoke vent communicated with the atomizer assembly and the vent holes. Since the nozzle and the atomizer assembly locate at the two ends of the battery rod assembly respectively, the nozzle is far away from the atomizer assembly, and the atomizer assembly is of good sealing, thus it can avoid smoke liquid being sucked into smoker mouth problem.

16 Claims, 2 Drawing Sheets

ELECTRONIC CIGARETTE

CROSS REFERENCE TO RELATED APPLICATIONS

The present application is a 35 U.S.C. §371 National Phase conversion of International (PCT) Patent Application No. PCT/CN2013/073873, filed on Apr. 8, 2013, the disclosure of which is incorporated by reference herein. The PCT International Patent Application was filed in Chinese.

FIELD OF THE INVENTION

The present invention relates to an electronic cigarette.

BACKGROUND OF THE INVENTION

Electronic cigarette is a simulated cigarette. The electronic cigarette uses heating wire to heat and atomize flavor contained substances to produce smoke for users smoking.

The existing electronic cigarette includes an atomizer assembly, an electronic rod assembly and a nozzle which are disposed at two ends of the atomizer assembly respectively. When smoking, the smoke produced by the atomizer assembly is fed into the nozzle directly from the atomizer assembly, and then into the smoker mouth, thus achieving smoking. However, since the distance between the nozzle and the atomizer assembly is very close, it usually causes problems that the smoke liquid is sucked into the smoker mouth. In addition, the existing electronic cigarette is difficult to meet the individual needs of users.

SUMMARY OF THE INVENTION

A technical problem of the present invention to be solved is to provide an electronic cigarette to send out smoke from a battery rod assembly, therefore to meet the individual needs of electronic cigarettes for most users.

To achieve the above-mentioned object, the present invention provides an electronic cigarette including a nozzle, a battery rod assembly and an atomizer assembly. The nozzle defines vent holes. The nozzle and the atomizer assembly are located at two ends of the battery rod assembly respectively, and the battery rod assembly defines a smoke vent communicated with the atomizer assembly and the vent holes.

Preferably, the battery rod assembly further includes a smoke tube, a battery-in protective sleeve accommodated in the middle inside the smoke tube, a battery disposed inside the battery-in protective sleeve, an internal thread seat sleeved at the bottom of the smoke tube and a first electrode insulatedly disposed inside the internal threads seat. The atomizer assembly includes a protective tube, liquid storage cotton disposed at the middle inside the protective tube, a smoke liquid storage tube set inside the liquid storage cotton, a heating wire assembly disposed inside the smoke liquid storage tube, an external thread seat installed at the top of the protective tube and a second electrode insulatedly disposed inside the external thread seat. The external thread seat is screwed into the internal thread seat, and both the first electrode and the second electrode are electrically connected with the heating wire assembly and the battery, an annular smoke vent is formed between the battery-in protective sleeve and the smoke tube; the nozzle is sleeved on the top of the smoke tube.

Preferably, a first insulating ring is disposed between the internal thread seat of the battery rod assembly and the first electrode.

Preferably, a second insulating ring is disposed between the external thread seat of the battery rod assembly and the second electrode.

Preferably, a first sealing ring is disposed at a position close to the nozzle on the top of the smoke tube.

Preferably, a cap with a lighting therein is disposed at the bottom of the protective tube.

Preferably, a second sealing ring is disposed at a position close to the bottom of the liquid storage cotton in the protective tube.

Preferably, the protective tube is made of metal, plastic, wood or paper material.

Preferably, a fixing support is disposed at the bottom of the battery-in protective sleeve. Inside the support disposes a smoke detector used to detect smoke concentration.

The advantage of the present invention are: since the nozzle and the atomizer assembly are locate at the two ends of the battery rod assembly respectively, the nozzle is far away from the atomizer assembly, and the atomizer assembly is of good sealing, thus it can avoid the problem of smoke liquid being sucked into smoker mouth. In addition, by forming a gap between the battery-in protective sleeve and the smoke tube in the battery of the battery rod assembly as the smoke vent to make the smoke produced by the atomizer assembly enter smoker mouth for smoking through the smoke vent, then it avoid the smoke being sent out from one end of the atomizer assembly to meet the individual needs of users for electronic cigarettes. Furthermore, the disposed protective sleeve in the battery can effectively protect the battery and the smoke detector, and then effectively avoid the corrosive effects of smoke on the battery and the smoke detector.

DETAILED DESCRIPTION OF THE INVENTION

Figure 1:
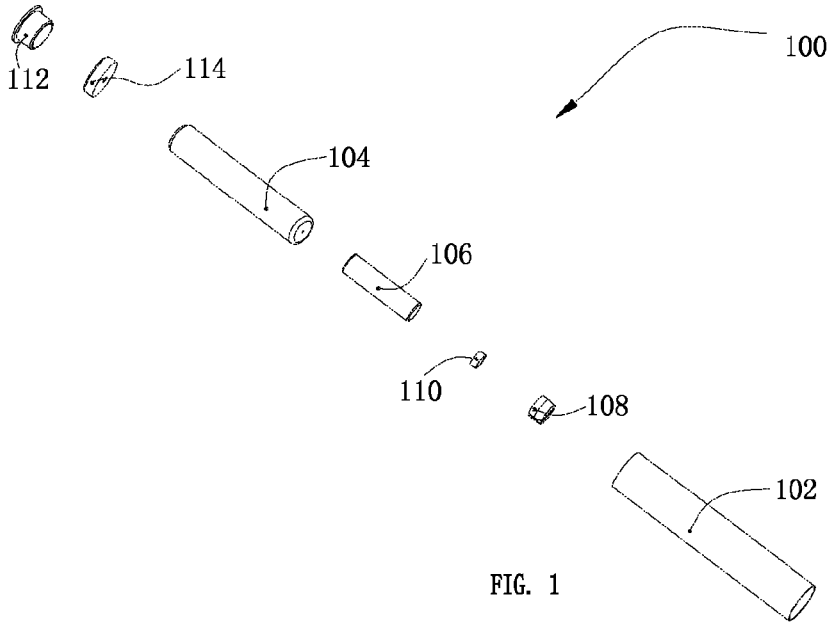
FIG. 1 is an isometric exploded view of the battery rod assembly for an electronic cigarette embodiment of the present invention.
Figure 2:
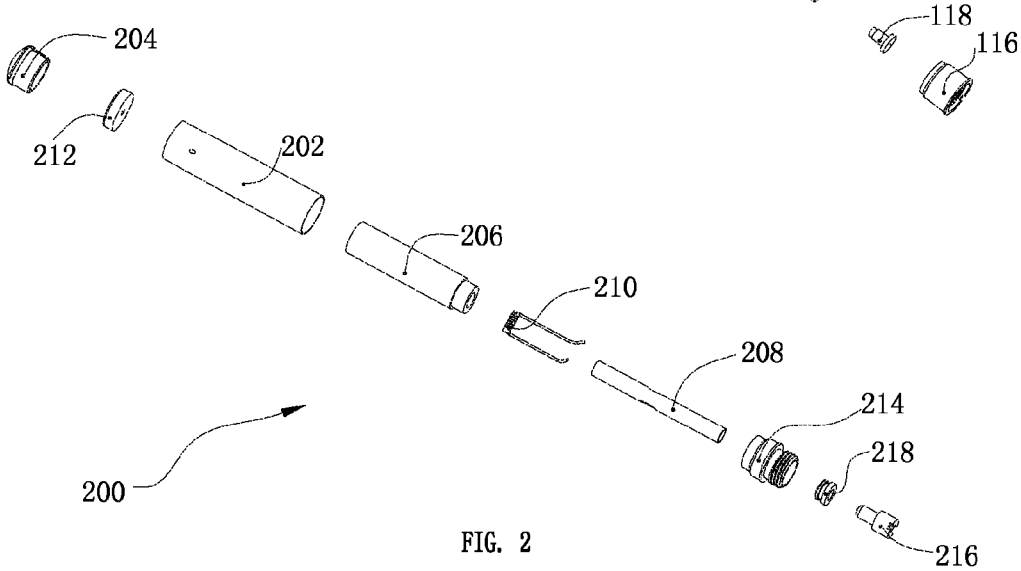
FIG. 2 is an isometric exploded view of the atomizer assembly for an electronic cigarette embodiment of the present invention.
Figure 3:
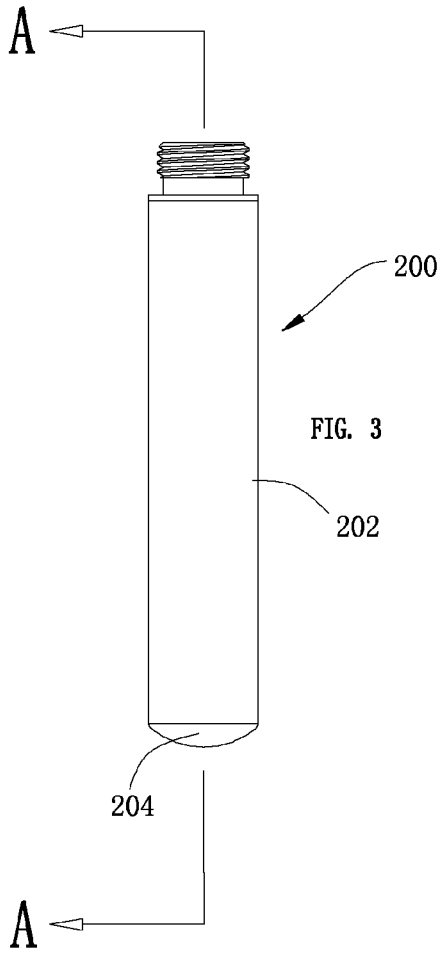
FIG. 3 is an isometric assembly drawing of the atomizer assembly shown in the FIG. 2.
Figure 4:
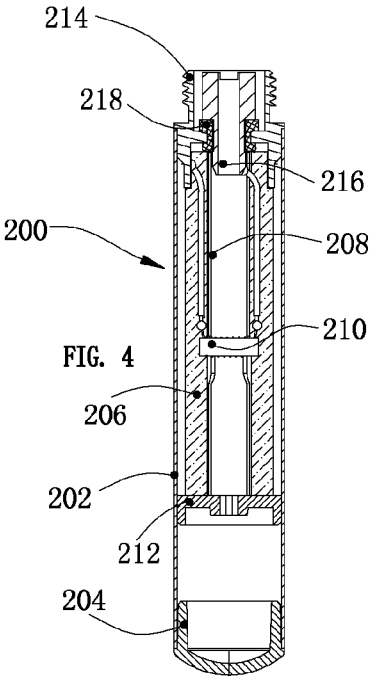
FIG. 4 is a sectional view of the atomizer assembly along the direction A-A shown in the FIG. 3.
Figure 5:
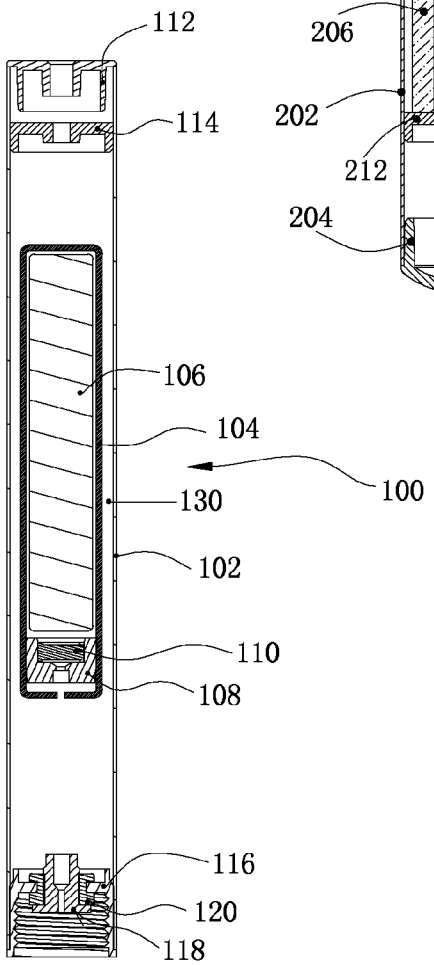
FIG. 5 is a longitudinal sectional view of the battery rod assembly shown in the FIG. 1.

Refer to FIG. 1 to FIG. 5, the present invention provides an electronic cigarette, which includes a battery rod assembly 100 and an atomizer assembly 200 connected with the battery rod assembly 100.

The battery rod assembly 100 includes a smoke tube 102, a battery-in protective sleeve 104 accommodated in middle of the smoke tube 102, a battery 106 disposed inside the battery-in protective sleeve 104, a nozzle 112 located at one end of the battery rod assembly 100 and sleeved on the top of the smoke tube 102, an internal thread seat 116 sleeved at the bottom of the smoke tube 102 and a first electrode 118 insulate disposed inside the internal thread seat 116. The nozzle 11 defines vent holes (not labeled). An annular smoke vent 130 is formed between the battery-in protective sleeve 104 and the smoke tube 102, and its function will be described later.

The atomizer assembly 200 includes a protective tube 202, a liquid storage cotton 206 disposed at a middle inside the protective tube 202, a smoke liquid storage tube 208 tightly disposed inside the liquid storage cotton 206, a heating wire assembly 210 disposed inside the smoke liquid storage tube 208, an external thread seat 214 installed at the top of the protective tube 202 and a second electrode 216 insulate disposed inside the external thread seat 214.

The external thread seat 214 is screwed into the internal thread seat 116, which makes the battery rod assembly 100 and the atomizer assembly 200 fixed to each other to form an electronic cigarette of the present invention. The nozzle 112 and the atomizer assembly 200 are located at two ends of the battery rod assembly 100 respectively. At the same time, both the first electrode 118 and the second electrode 216 are electrically connected with the heating wire assembly 210 and the battery 106. When the battery 116 supplying power to the two electrodes 118 and 216, the battery 106 and the two electrodes 118 and 216 and the heating wire assembly 210 form a complete circuit loop. Then current flows through the heating wire assembly 210, which causes the heating wire assembly 210 heating to atomize the smoke liquid stored in the liquid storage cotton 206. Because an annular smoke vent 130 is formed between the battery-in protective sleeve 104 and the smoke tube 102, the smoke produced by heating and atomizing the liquid will move along the annular smoke vent 130 to the nozzle 112 which is disposed on the top of the smoke tube 102, then users can suck smoke through the nozzle 112.

In the present invention, since smoke moves along the annular smoke vent 130 to the nozzle 113, in other words, smoke is sent out from the battery rod assembly but not from one end of the atomizer assembly 200, thus it can meet users individual needs on the electronic cigarettes.

Preferably, a first insulating ring 120 is disposed between the internal thread seat 116 of the battery rod assembly 100 and the first electrode 118, which obviously improves the electrical insulation between the internal thread seat 116 and the first electrode 118.

Similarly, a second insulating ring 218 is disposed between the external thread seat 214 of the atomizer assembly 200 and the second electrode 216, which obviously improves the electrical insulation between the external thread seat 214 and the second electrode 216.

Preferably, a first sealing ring 114 is disposed at a position close to the nozzle 112 on the top of the smoke tube 102, thus can prevent the smoke liquid on the liquid storage cotton 206 flowing out from the nozzle 112.

Preferably, a cap 204 with a lighting therein is disposed at the bottom of the protective tube 202.

Preferably, a second sealing ring 212 is disposed at a position close to the bottom of the liquid storage cotton 206 in the protective tube 202, thus can prevent the smoke liquid on the liquid storage cotton 206 flowing out from the cap 204 with a lighting therein.

Preferably, the protective tube 202 is made of metal, plastic, wood or paper material.

Preferably, a fixing support 108 is disposed at the bottom of the battery-in protective sleeve 104. Inside the support 108 disposes a smoke detector 110 used to detect smoke concentration.

Furthermore, the disposed battery-in protective sleeve 104 can effectively protect the battery 106 and the smoke detector 110, and then effectively avoid the corrosive effects of smoke on the battery 106 and the smoke detector 110.

Embodiments of the present invention is shown and described in the above-mentioned. Various improvement and modifications can be made to the embodiments by those skilled in the art without departing from the true spirit and scope of the disclosure. The scope of the present invention is defined by the appended claims and equivalents thereof.

What is claimed is:

1. An electronic cigarette, comprising:

a nozzle for user to suck smoke, a battery rod assembly and an atomizer assembly, the nozzle defining vent holes;

wherein the nozzle and the atomizer assembly are located at two opposite ends of the battery rod assembly respectively, and the battery rod assembly defines a smoke vent communicated between the atomizer assembly and the vent holes;

the battery rod assembly comprises a smoke tube, a battery-in protective sleeve accommodated in the smoke tube, and a battery disposed inside the battery-in protective sleeve; the nozzle is located at a top end of the battery rod assembly and is sleeved on a top end of the smoke tube, a first thread seat is sleeved at a bottom end of the smoke tube with a first electrode insulation disposed inside;

the atomizer assembly comprises a protective tube, a liquid storage cotton and a heating wire assemble disposed inside the protective tube, and a second thread seat installed at a top end of the protective tube with a second electrode insulation disposed inside;

the battery rod assembly and the atomizer assembly are fixed to each other to form the electronic cigarette via both the first thread seat at a bottom end of the smoke tube and the second thread seat installed at a top end of the protective tube are screwed with each other, whereby the atomizer assembly is mounted at a bottom end of the battery rod assembly; and the smoke vent is an annular smoke vent formed between the battery-in protective sleeve and the smoke tube in the battery rod assembly, smoke being produced in the atomizer assembly flows along the smoke vent in the battery rod assembly to the nozzle for users to suck smoke; the smoke is sent out from the battery rod assembly to enter smoker mouth for smoking.

2. According to the electronic cigarette in claim 1, wherein:

the atomizer assembly further includes a smoke liquid storage tube set inside the liquid storage cotton, the heating wire assembly disposed inside the smoke liquid storage tube;

a smoke detector used to detect smoke concentration is disposed in the battery-in protective sleeve; and the disposed battery-in protective sleeve is used to protect both the battery and the smoke detector from corrosive effects of smoke.

3. According to the electronic cigarette in claim 1, wherein a first insulating ring is disposed between the first thread seat of the battery rod assembly and the first electrode.

4. According to the electronic cigarette in claim 1, wherein a second insulating ring is disposed between the second thread seat of the battery rod assembly and the second electrode.

5. According to the electronic cigarette in claim 1, wherein a first sealing ring is disposed at a position close to the nozzle on the top of the smoke tube.

6. According to the electronic cigarette in claim 1, wherein a light cap is disposed at the bottom of the protective tube.

7. According to the electronic cigarette in claim 1, wherein a second sealing ring is disposed at a position close to the bottom of the liquid storage cotton in the protective tube.

8. According to the electronic cigarette in claim 1, wherein the protective tube is made of metal, plastic, wood or paper material.

9. An electronic cigarette, comprising:

a nozzle, a battery rod assembly and an atomizer assembly, the nozzle defining vent holes, wherein the nozzle and the atomizer assembly are located at two ends of the battery rod assembly respectively, and the battery rod assembly defines a smoke vent communicated with the atomizer assembly and the vent holes;

the battery rod assembly further includes a smoke tube, a battery-in protective sleeve accommodated in the middle inside the smoke tube, a battery disposed inside the battery-in protective sleeve, an internal thread seat sleeved at the bottom of the smoke tube and a first electrode insulation disposed inside the internal threads seat;

the atomizer assembly includes a protective tube, liquid storage cotton disposed at the middle inside the protective tube, a smoke liquid storage tube set inside the liquid storage cotton, a heating wire assembly disposed inside the smoke liquid storage tube, an external thread seat installed at the top of the protective tube and a second electrode insulation disposed inside the external thread seat;

the external thread seat is screwed into the internal thread seat, and both the first electrode and the second electrode are electrically connected with the heating wire assembly and the battery, the smoke vent is formed between the battery-in protective sleeve and the smoke tube;

the nozzle is sleeved on the top of the smoke tube; wherein a fixing support is disposed at the bottom of the battery-in protective sleeve, inside the support disposes a smoke detector used to detect smoke concentration.

10. An electronic cigarette, comprising:

a battery rod assembly, the battery rod assembly including a nozzle located at one end of the battery rod assembly, the nozzle defining vent holes; and an atomizer assembly, the atomizer assembly connected at another end of the battery rod assembly opposite to the nozzle;

wherein the battery rod assembly defines a smoke vent communicated with the atomizer assembly and the vent holes;

the battery rod assembly further includes a smoke tube, a battery-in protective sleeve accommodated in the middle inside the smoke tube, the smoke vent is formed between the battery-in protective sleeve and the smoke tube, the nozzle is sleeved on the top of the smoke tube;

the smoke tube defines an internal thread seat sleeved at the bottom thereof and a first electrode insulation disposed inside the internal threads seat the atomizer assembly further includes a protective tube, an external thread seat installed at the top of the protective tube, and a second electrode insulation disposed inside the external thread seat, the external thread seat is screwed into the internal thread seat;

the battery rod assembly further includes a battery disposed inside the battery-in protective sleeve, the atomizer assembly further includes a liquid storage cotton disposed at the middle inside the protective tube, a smoke liquid storage tube set inside the liquid storage cotton, a heating wire assembly disposed inside the smoke liquid storage tube, and both the first electrode and the second electrode are electrically connected with the heating wire assembly and the battery;

a fixing support is disposed at the bottom of the battery-in protective sleeve, inside the support disposes a smoke detector used to detect smoke concentration.

11. According to the electronic cigarette in claim 10, wherein a first insulating ring is disposed between the internal thread seat of the battery rod assembly and the first electrode.

12. According to the electronic cigarette in claim 10, wherein a second insulating ring is disposed between the external thread seat of the battery rod assembly and the second electrode.

13. According to the electronic cigarette in claim 10, wherein a first sealing ring is disposed at a position close to the nozzle on the top of the smoke tube.

14. According to the electronic cigarette in claim 10, wherein a light cap with a lighting therein is disposed at the bottom of the protective tube.

15. According to the electronic cigarette in claim 10, wherein a second sealing ring is disposed at a position close to the bottom of the liquid storage cotton in the protective tube.

16. According to the electronic cigarette in claim 10, wherein the protective tube is made of metal, plastic, wood or paper material.

* * * * *